United States Patent [19]

Higute et al.

[11] 4,223,628

[45] Sep. 23, 1980

[54] APPARATUS FOR PUSHING A BARGE WITH A PUSH BOAT

[75] Inventors: Michinosuke Higuti; Tatsuki Yoshikai, both of Yokohama, Japan

[73] Assignee: Nippon Kokan Kabushiki Kaisha, Tokyo, Japan

[21] Appl. No.: 937,535

[22] Filed: Aug. 28, 1978

Related U.S. Application Data

[63] Continuation of Ser. No. 787,032, Apr. 18, 1977, abandoned.

[51] Int. Cl.[3] ..... B63B 21/00

[52] U.S. Cl. ..... 114/246; 114/247; 114/249

[58] Field of Search ..... 114/77 R, 247, 242, 114/246, 249, 250, 248, 251, 252; 280/446 R, 481

[56] References Cited

U.S. PATENT DOCUMENTS

| | | | |
|---|---|---|---|
| 152,099 | 6/1874 | Frick | 114/246 |
| 344,612 | 6/1886 | Balletto | 114/246 |
| 3,062,170 | 11/1962 | Verneaux | 280/446 R |
| 3,125,059 | 3/1964 | Verneaux | 114/246 |
| 3,237,588 | 3/1966 | Erlbacher | 114/246 |
| 3,611,977 | 10/1971 | Mosvold | 114/246 |
| 3,645,225 | 2/1972 | Lunde | 114/246 |

*Primary Examiner*—Trygve M. Blix
*Assistant Examiner*—D. W. Keen
*Attorney, Agent, or Firm*—Moonray Kojima

[57] ABSTRACT

An improved apparatus for controlling the relative course of travel between a barge and a push boat wherein the stern of the barge and the bow of the push boat are directly connected together by a connecting mechanism which permits relative freedom of movement of the boat and barge and the rudder angle of the push boat is controlled by the relative drift angle between the barge and boat occurring at the connecting mechanism.

1 Claim, 10 Drawing Figures

37

APPARATUS FOR PUSHING A BARGE WITH A PUSH BOAT

This is a continuation of application Ser. No. 787,032 filed Apr. 18, 1977.

BACKGROUND OF THE INVENTION

This invention relates to an improved apparatus for pushing a barge with a push boat, and more particularly, to an improvement in the controlling of the rudder angle of the push boat by the relative drift angle between the barge and the push boat occuring at the connecting mechanism.

Generally, a barge which is employed to transport cargoes, such as earth, sand and the like, in various water ways, harbors, rivers, lakes, marshes, etc, is pushed by a pusher system using a push boat. In such cases, it is required to make and keep in a substantially straight line, the longitudinal center lines of both vessels for optimal pushing and to keep the barge on course. There are, however, many difficulties and deficiencies involving the connecting mechanism between the barge and boat, and involving controlling of the drift angle occuring at the connecting mechanism. For example, the strength of the connecting means, e.g. wire rope which is normally used to connect a large scale barge to a push boat, is important. Difficulties are produced by relative displacement between the barge and the connecting means, which mainly is based on behavior of the waves.

It is well known that displacements occur in the relative motion of the two vessels which are produced in the longitudinal direction, transverse direction, vertical direction, or a combination thereof, mainly by rolling, pitching and turning of the two vessels, respectively. In any case, they influence adversely, the keeping on course of the barge. Some slippage from the extended straight center lines and consequent running off course is unavoidable. Unfortunately, the most suitable and usable countermeasure has not yet been developed.

SUMMARY OF THE INVENTION

An object of the invention is to eliminate the aforementioned and other deficiencies and difficulties of the prior art.

The foregoing and other objects are attained in this invention which encompasses apparatus for controlling the steering of a push boat in response to angular variances from the center line extending through the longitudinal centers of the push boat and barge. A connecting device connects the push boat to the barge with a device detecting the anular difference and mechanically, electrically, or hydraulically, relaying the detected error signal to a steering device which then turns the rudder of the push boat suitably to correct the angular error cause the barge to go back on course.

In one embodiment, the connecting device comprises a supporting means attached to the barge, a unit which allows vertical and transverse free movements and rigid horizontal movement together with the horizontal movement of the barge, attached to the support means, a holder connected to the push boat for holding the unit, and means for detecting the horizontal angular movement of the unit. The detecting means through linkage means then controls the rudder movement to thereby correct the errors away from the center line.

In another embodiment, the detection of the angular change is by electrical means and a suitable feedback circuit and motors are used to turn the rudder suitably to make the barge go back oncourse.

In a further embodiment, the detecting and controlling is by hydraulic means.

Advantageously, the correction is done simply and without necessity of tie ropes, double bows or notched sterns. Moreover, the vertical and transverse free movements of the connecting means enables the two vessels to independently roll, pitch, or move vertically and transversely without affecting the controlling arrangement.

A feature of this invention is the method of detecting angular change from the center line extending longitudinally through the centers of both vessels, at the connecting device which connects the two vessels, and responsive thereto causing the rudder of the push boat to correct the error.

Another feature of the invention is the connecting device which is vertically and transversely movable to allow for independent movement of the two vessels and which is horizontally rigidly connected to the stern of the barge to enable suitable detection of the angular change from the center line by another apparatus connected to the push boat.

A further fearture is the use of mechanical linkages to transmit the detection of angular change to the rudder operation.

Another feature of the invention is the use of hydraulic apparatus to effect the determination and correction of the directional travel off course of the barge.

A still further feature of the invention is the use of electrical apparatus to detect and correct the angular change.

DETAILED DESCRIPTION OF PREFERRED EMBODIMENTS

Figure 1:
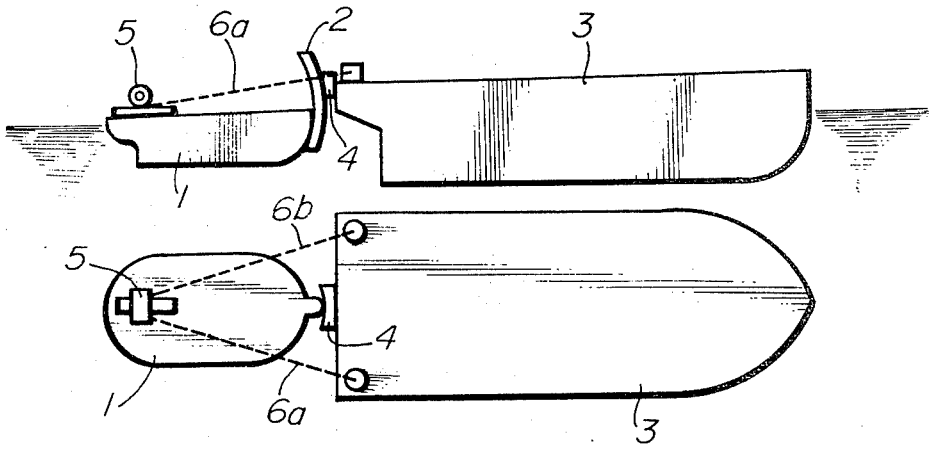
FIGS. 1, 2, 3 depict plan and elevational views of different prior art embodiments.

FIG. 1 depicts a prior art arrangement comprising a One Pole Two Wire Rope device connecting a barge to a push boat. A circular shaped push bar 2 is attached to the bow (sometimes also called stem) of a push boat 1, and is pressed against a thrust bearer 4 attached to the stern of the barge 3. Two wire ropes *6a,6b* of suitable dimensions are suitably attached to the rear of the barge 2 through a winch 5, as depicted. The barge 3 and push boat 1 are united and maintained united by winding the winch 5 to tighten the wire ropes 6a,6b. The relative motions in the longitudinal and transverse directions and of turning are restrained, but the relative vertical motions of rolling and pitching of the two vessels are free.

Figure 2:
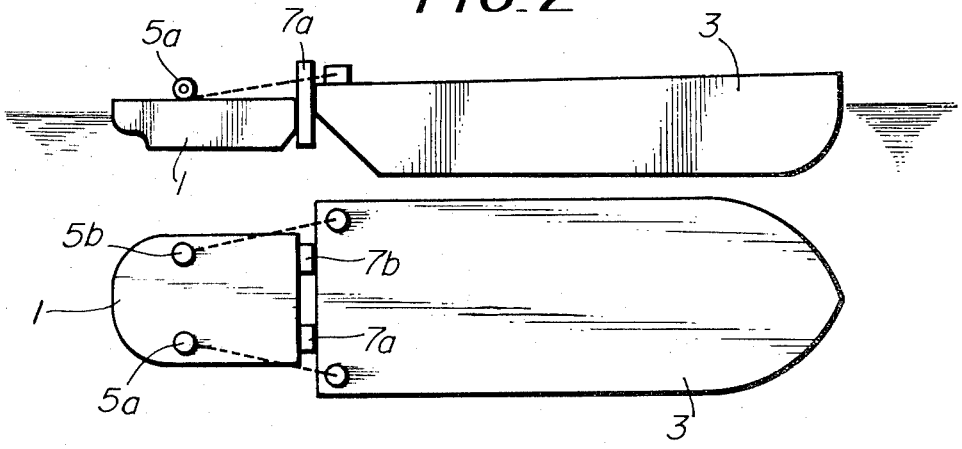

FIG. 2 is a prior art arrangement comprising a Two Pole Two Wire device for connecting the two vessels. Two vertical bars 7a, 7b are attached to the bow of the push boat 1 and two wire ropes (unnumbered) are connected to respective standards on the stern of barge 3 as depicted, with the other ends of the ropes connected to winches 5a and 5b. The two vertical bars 7a,7b are pressed against the flat portions of the stern of the barge by taking in the winches and tightening the ropes. This type of connecting mechanism may be effectively employed where waves are small and where pitching and rolling and rocking of the barge and push boat are little, such as small rivers, lakes and marshes.

Figure 3:
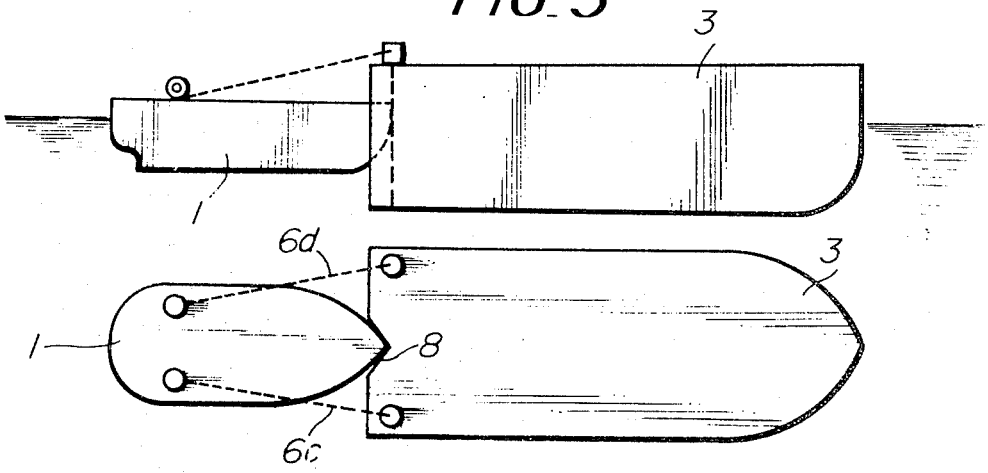

FIG. 3 depicts another prior art arrangement employing a "V"-notch connecting device. The bow of push boat 1 is fitted to and is pressed against a vertical groove 8 arranged on the stern of the barge through a buffer material, such as a rubber tube. A pair of elastic ropes 6c,6d, such as of nylon, are used. The above device restrains the relative motion in the longitudinal and transverse directions, but permits some rolling, turning and pitching and vertical movements.

Although the prior art mentioned above display some advantages, there are a certain number of disadvantages. For example, there is a limit as to relative movement between the two vessels based on the strength of the connecting ropes. Thus, usually, the larger the barge, the larger and thicker the ropes. Such a disadvantage will be seen in each of the above arrangements in which one or more ropes are used.

Figure 10:
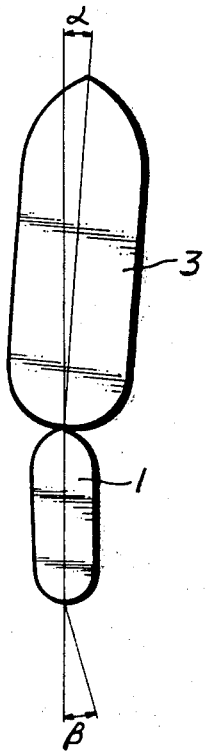
FIG. 10 depicts pictorially the slippage from a straight line extending through the longitudinal centers of the two vessels.

This invention resolved the above difficulties of the prior art. One consideration is to make and keep straight the line passing through the horizontal longitudinal center lines of the two vessels by automatically adjusting any directional slippage from the extended center lines. When the barge and push boat are travelling along the extended center lines, the barge will be on course. Generally, the relation of drift angle between the two vessels to the rudder angle of the push boat is as shown in FIG. 10. When the center lines of the two vessels are concurrent, the relationship between the two is as follows:

$$\text{Alpha } (\alpha)=0 \text{ Beta } (\beta)=0.$$

In such a state, when drift angle alpha, if more than zero, is produced from one cause or another, barge 3 will be turned to the direction of the drift angle alpha since the rudder angle beta of the push boat 1 remains as is. At this moment, the push boat 1 will be turned, by which the rudder angle beta is adjusted to the same direction as the drift angle alpha that is produced. That is, if the turning angle velocity of push boat 1, which is based on adjusting the rudder angle beta, is larger than that of the barge 3 based on the drift angle alpha, the drift angle alpha gradually decreases, until, finally, the travelling direction of the barge 3 will be returned to the required course direction. In such a case, it is important that the rudder angle be automatically adjusted as the drift angle is produced. Embodiments to accomplish such action are shown in the remaining figures FIGS. 4–9.

Figure 4:
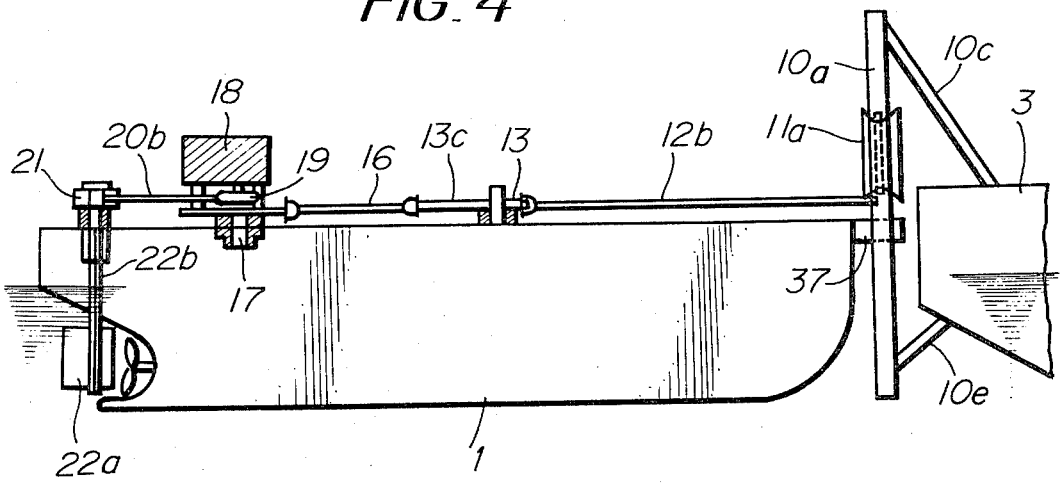
FIG. 4 depicts an elevational view of an illustrative embodiment of this invention.
Figure 5:
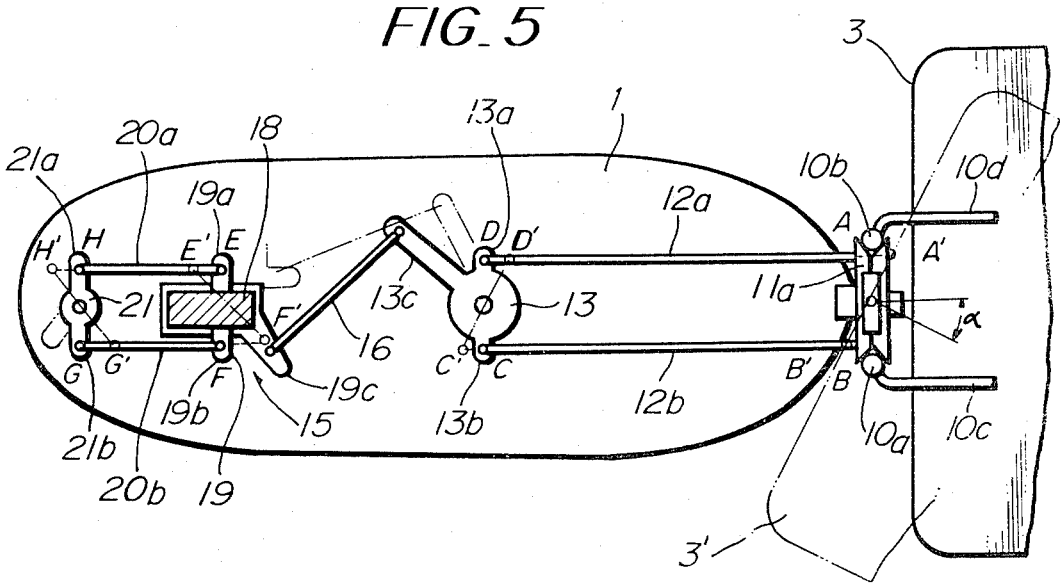
FIG. 5 depicts a plan view of the embodiment of FIG. 4.
Figure 6:
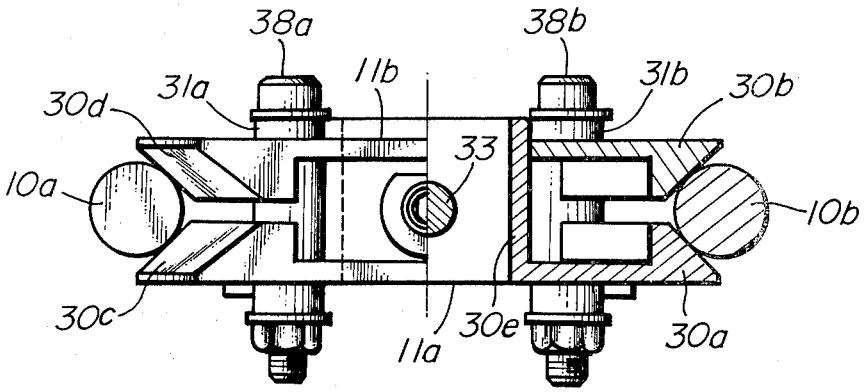
FIG. 6 depicts a partial cross sectional plan view of the connection device of the embodiment of FIG. 5.
Figure 7:
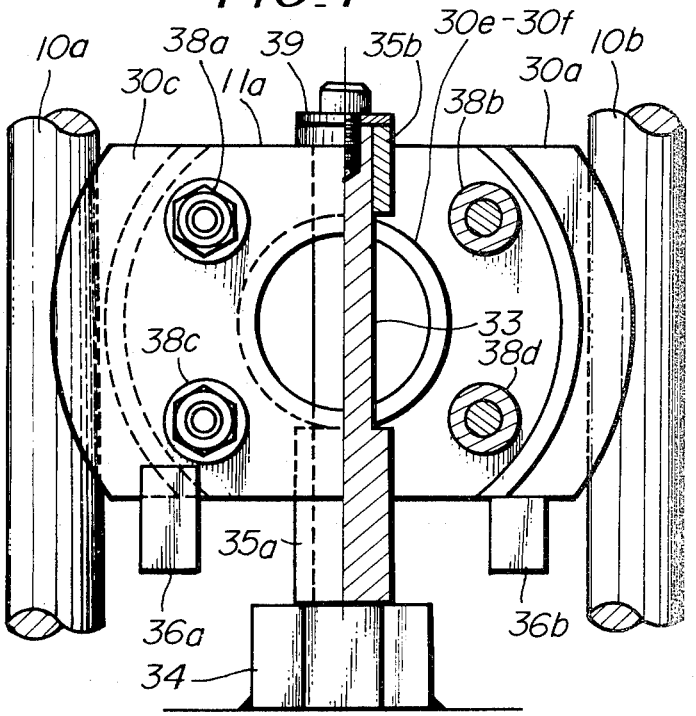
FIG. 7 depicts a partial cross sectional elevational view of the connection device of the embodiment of FIG. 5.

FIGS. 4,5,6 depict an illustrative mechanical embodiment. Barge 3 and push boat 1 are connected by connecting apparatus which enables relatively free motion between the barge 3 and push boat 1.

In FIGS. 4 and 5, supports 10a,10b,10c,10d,10e,10f are connected to the stern of barge 3. The connecting mechanism is depicted in greater detail in FIGS. 6 and 7. A main connecting body 30a,30b and 30c,30d are slidably connected to sleeves 31a and 31b respectively. The vertical portions 10a,10b of the supports are fitted to the main body as depicted in FIG. 6 between the facing ends forming a "V", 30c, 30d, 30a, 30b, respectively. Both sides 30a,30c,30b,30d, are held by plates 11a, 11b, respectively. In this manner the connecting device is connected to the stern of the barge 3.

The connecting mechanism is held by bolts and nuts 38a, 38b, 38c, and 38d with sleeves 31a,31b,31c and 31d, respectively. The main body 30a, 30b, 30c and 30d is slidable on the sleeves.

The connecting device is connected to push boat 1 by shaft 33 passed vertically through the center of the above mechanism and affixed to base 34 which is connected to projection 37 of the bow of push boat 1. The upper step 35b and lower step 35a are formed in the middle of shaft 33, and the extension member 30e,30f of the main connecting body 30a,30c is fitted to the middle portion between the steps. The top portion of shaft 33 is locked with a nut 39. In this manner, shaft 33 is prevented from slipping out.

Advantageously, the just described mechanism enables independent motion between the two vessels. For example, in the longitudinal axis direction, movement is provided by slidable mechanism between the main connecting body 30 and sleeve 31. The transverse axis movement is with the fitting mechanism between shaft 33 and extension members 30e,30f. The vertical axis movement is provided with the "V" shaped ends of main body 30a,30b and 30c,30d and vertical poles 10a,10b. Thus, relative movement is allowed in the case of rolling, pitching, turning and any combination thereof, and advantageously, no breakdown of the connecting device will occur.

Turning now to FIGS. 4 and 5, the control mechanism comprises linkages to the connecting device, steering means and rudder. A first linkage 13 comprising projections 13a,13b,13c, is movably arranged at the middle of the push boat 1. Projections 13a,13b are affixed to connecting mounts 36a and 36d (shown in FIG. 7) via parallel connecting rods 12a,12b, respectively. Arm 13c is used to connect a steering means to be discussed hereinbelow.

Next, a second linkage 21 having projections 21a,21b is fixed to the top of rudder shaft 22b (see FIG. 4) which is connected to rudder 22a.

A third linkage 19 having projections 19a,19b,19c is arranged toward the front of second linkage 21. The projections 19a,19b are connected to projections 21a,21b through parallel connecting rods 20a,20b, respectively. Usual type steering mechanism 15,18 (not shown in detail) (The operational characteristics of the steering mechanism are not per se part of the invention and are conventional and well known. Examples of steering mechanisms and connecting means between the steering and rudder, can be found for example in U.S. Pat. Nos. 1,946,693; 2,420,154; 3,603,167 and others. Mechanical servo systems are shown for example in U.S. Pat. No. 2,136,213. Automatic steering mechanisms are shown for example in U.S. Pat. No. 2,324,882.) is arranged on and connected to the above third linkage 19 and is held by a shaft 17 (see FIG. 4)

fixed to a suitable part of boat 1. The steering mechanism itself is, of course, used for changing the course of direction by manual or automatic turning of the rudder 22*a* and is well known.

In operation, when the pushing direction of the barge 3 is in the required course, which is determined by the steering mechanism 18, the relationship between the above linkages becomes as shown in FIG. 5, forming rectangles ABCD and EFGH. If a deviation occurs from the straight line passing through the longitudinal center lines of the barge 3 and push boat 1, i.e. a drift angle alpha occurs at the connecting device, the rectangle ABCD is changed and becomes a parallelogram A'B'C'D' (see dotted line in FIG. 5) corresponding to the drift angle. When the barge undergoes a slippage or deviation (such as shown by barge 3') from the center line, the connecting mechanism mainly comprising the poles and the stays 10*a*, 10*b*, 10*c*, 10*d*, 10*e*, 10*f*, the holding plates 11*a*, 11*b* and the holding mounts 36*a*, 13*b* rotate on shaft 33 fixed to the projection 37. The connecting rod 12*a* is pulled and the other connecting rod 12*b* is pushed by the rightward or clockwise turning of the stern of the barge 3. This causes rotation of the linkage 13.

The rotation of linkage 13 moves arm 13*c* to cause connecting rod 16 to rotate arm 19*c* of linkage 19. The rotation of linkage 19 causes connecting rod 20*a* to be pulled (when arm 19*c* moves clockwise) and connecting rod 20*b* to be pushed (when arm 19C moves clockwise. On the other hand, when arm 19C moves counterclockwise, rods 20*a* and 20B are pushed and pulled, respectively. As a result, the linkage 21 is rotated by the amount of the above drift angle and the rectangle EFGH is changed into parallelogram E'F'G'H' (dotted lines). The rudder 22*a* is moved a suitable angle by rotation of shaft 22*b*. In such a manner, since the changing of the rudder angle corresponds to the drift angle of the barge, the deviation of the barge from the center line is corrected and the barge returns to the required course. Thus, the drift angle alpha produced in the connecting device is automatically corrected to the center line with ease and without delay.

Barges and push boats display their own periodic motions in rocking, pitching, turning or any combination thereof depending on the behavior of the waves. Thus, the connecting mechanism must be constructed so that the relative motions between the two vessels are not restrained and are free. Advantageously, the connecting arrangement of the invention enables relative motion between the two vessels.

Figure 9:
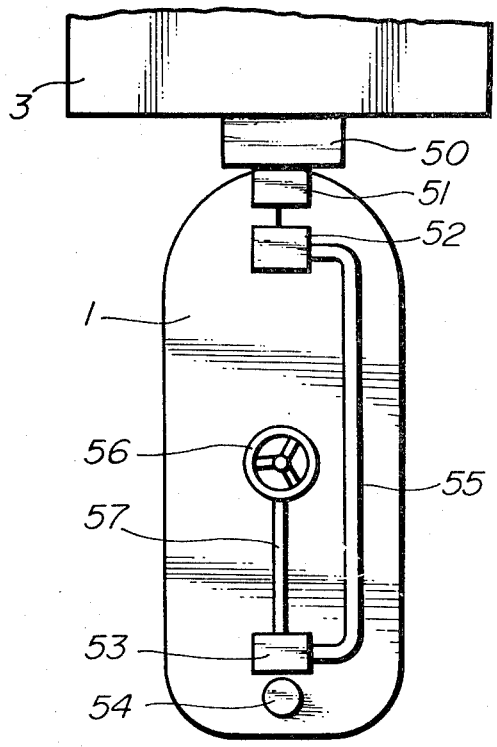
FIG. 9 depicts a simplified plan view of another control system.
Figure 8:
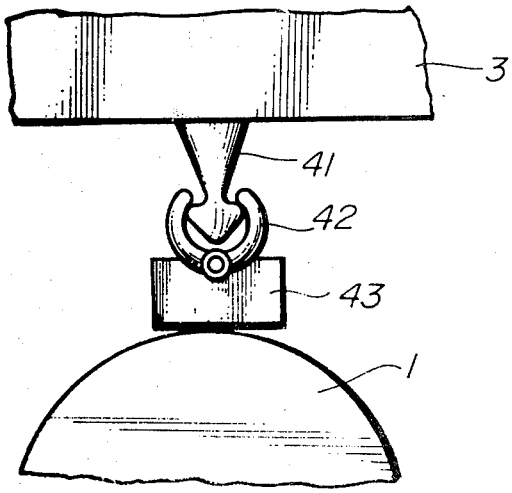
FIG. 8 depicts a simplified plan view of another connecting device.

FIG. 8 depicts another illustrative connecting device of this invention, comprising a holder 41 having a substantially spherically shaped end and affixed to the stern of boat 3, and a substantially half-round pole 42 affixed to the bow of the push boat 1 through a projection 43. The spherically shaped end 41 is is inserted into pole 42 with a suitable clearance therebetween, as depicted. Also, suitable means of detecting the drift angle between the two vessels (not shown) and a control system for operating the rudder in response to the detection of the drift angle, are provided. The drift angle may thus be automatically corrected and the travel direction of the barge may be returned to the required travel course. The detecting mechanism for detecting the drift angle and the control system for operating the rudder angle depicted in FIG. 8 may be the mechanical devices shown in FIG. 5. However, hydraulic or electrical systems have certain advantages and may also be used. FIG. 9 depicts an embodiment wherein hydraulic or electrical systems are used.

The illustrative embodiment of FIG. 9 comprises a suitable connecting mechanism attached to the stern of barge 3 and a detecting mechanism 51 for detecting the drift angle produced in the connecting mechanism 50. The detecting mechanism may include a differential transformer (see for example page 638 et seq in Electrical Machinery, by A. E. Fitzgerald and Charles Kingsley, Jr. 1952, McGraw Hill for descriptions of typical circuits). or a potentiometer (see for example page 1089 in Physics, Vol. II, by George Shortley, and Dudley Williams, 1950, Prentice-Hall, for description of typical circuits). The detector will cause a hydraulic pressure or an electrical signal to be generated in generator device 52, which signal or pressure is then fed back through circuit 55, such as transfer tube or cable, to operating mechanism 53 for controlling the rudder steering device 54. Well known circuits and devices may be used for the block diagram representations of same in the drawing. These are not per se inventive. Examples of steerng by electrical means and control thereby are shown for example in U.S. Pat. Nos. 3,673,977; 3,660,742; 2,736,856 and others. Hydraulic steering and control systems are shown for example in U.S. Pat. No. 3,798,525 and others. A usual type steering mechanism 56, such as shown in FIGS. 4,5 is arranged and connected to the operating mechanism 53 through a transmittal line 57. Thus, when there is a slippage from the center lines extending through the two vessels, which becomes a drift angle in the connecting mechanism 50 between the barge and push boat, the drift angle is detected by the detector 51 and a signal is generated in generator 52 and fed back to operating mechanism 53 via circuit 55, thereby to automatically control the steering device 54 to return the barge to the center line, without delay.

As above discussed, this invention is concerned with keeping a straight line between the barge and push boat. It is not concerned per se with the steering between the boats. The steering mechanisms per se are not inventive and any known mechanisms, such as those described in the patents listed at page 7, line 23, maybe used. In the above, a mechanical linkage system, as one preferred embodiment, is disclosed to show the working of the detection of the angle of deviation from the straight line by means located at the connection between the barge and push boat, and the subsequent steering of the push boat back to the straight line.

The foregoing is illustrative of the principles of this invention. Various modifications and extensions thereof would be apparent to the worker skilled in the art. All such modifications and extension are to be considered to be within the spirit and scope of the invention.

What is claimed is:

1. Apparatus for pushing a barge with a push boat, comprising (A) connecting mechanism disposed between said barge and said push boat and constructed in such a manner that relative motion therebetween is free, said connecting mechanism comprising, in combination, (a) a connecting body, a plurality of plates, and a plurality of sleeves, said connecting body comprising a first set of connecting units and a second set of connecting units held by said plates and slidable on said sleeves to define V-shapes between said first set of connecting units and between said second set of connecting units, (b) a plurality of poles and a plurality of members, said poles being supported within said V-shapes and positioned at the front end of said push boat via said members, (c) a first shaft, a projection, a base, and a plurality of extending members, said first shaft vertically running through substantially the center of said connecting mechanism and secured on said projection at the front end of said push boat via said base, said first shaft being formed with an upper step and a lower step between which said extending members of said first set of connecting units are arranged, (B) a first linkage and set of first connecting rods, said first linkage turnably connected to said connecting mechanism via said first connecting rods to form a rectangle therewith which turns out a parallelogram by means of a drift angle caused by said barge, (C) a second linkage and a second connecting rod, said second linkage turnably provided at the back of said push boat and connected to said first linkage via said second connecting rod, (D) a steering mechanism and a second shaft, said steering mechanism provided on a heat of said second shaft supporting said second linkage, and (E) a third linkage and a set of third connecting rods, said third linkage turnably provided on a head of a rudder shaft at the back end of said push boat and connected to said second linkage via said set of third connecting rods to form a rectangle therewith which turns out a parallelogram symmetrical to said parallelogram formed by said first linkage, by means of a drift angle transmitted through said rectangle, wherein with respect to the relative motion between said barge and said push boat through said connecting mechanism, a longitudinal displacement is provided by sliding action caused between said sets of first and second connecting units and said sleeves, and a transverse displacement is provided by sliding action caused between said first shaft and said extending members, and a vertical displacement is provided by sliding action caused between the V-shapes defined with the first and second connecting units and said poles.

* * * * *